US005927433A

United States Patent [19]

Jaramillo, Sr.

[11] Patent Number: 5,927,433

[45] Date of Patent: Jul. 27, 1999

[54] BOAT STEP WITH IMPROVED SUPPORT AND RETRACTION MECHANISM

[76] Inventor: Alfonso Jaramillo, Sr., 20205 Lounsberry Rd., Lake Matthews, Calif. 92570

[21] Appl. No.: 08/961,880

[22] Filed: Oct. 31, 1997

[51] Int. Cl.[6] ..... E04G 3/00

[52] U.S. Cl. ..... 182/91; 182/89; 182/92; 182/97; 280/166; 114/362; 114/270

[58] Field of Search ..... 182/89, 90, 91, 182/92, 97; 280/166; 114/362, 270; 441/39; 403/111, 144, 163

[56] References Cited

U.S. PATENT DOCUMENTS

| | | | |
|---|---|---|---|
| 2,653,036 | 9/1953 | Creel et al. | 182/91 |
| 2,670,968 | 3/1954 | Duffy | 280/167 |
| 2,678,832 | 5/1954 | Wright | 182/91 |
| 2,809,849 | 10/1957 | Benne | 280/166 |
| 3,313,374 | 4/1967 | Teach | 182/89 |
| 3,517,942 | 6/1970 | Cuffe et al. | 283/166 |
| 3,794,140 | 2/1974 | Sell | 182/92 |
| 3,825,097 | 7/1974 | Owen | 182/91 |
| 3,862,670 | 1/1975 | Hovey | 182/89 |
| 3,891,261 | 6/1975 | Finneman | 296/1 R |
| 3,961,809 | 6/1976 | Clugston | 182/91 X |
| 3,986,503 | 10/1976 | Guillon | 182/89 |
| 4,191,388 | 3/1980 | Barksdale | 280/166 |
| 4,231,583 | 11/1980 | Learn | 280/166 |
| 4,462,485 | 7/1984 | Terry et al. | 182/91 X |
| 4,556,125 | 12/1985 | Johnson | 182/91 |
| 4,688,508 | 8/1987 | Nishida | 114/362 |
| 4,712,503 | 12/1987 | Ritten | 114/343 |
| 4,926,965 | 5/1990 | Fox | 182/89 |
| 4,982,974 | 1/1991 | Guidry | 182/91 X |
| 5,085,164 | 2/1992 | Whitton | 114/362 |
| 5,085,165 | 2/1992 | Reed | 114/362 |
| 5,152,244 | 10/1992 | Jaramillo, Jr. et al. | 114/362 |
| 5,458,080 | 10/1995 | Jaramillo, Sr. | 114/362 |

*Primary Examiner*—Daniel P. Stodola
*Assistant Examiner*—Bruce A. Lev
*Attorney, Agent, or Firm*—Cislo & Thomas LLP; David L. Hoffman, Esq.

[57] ABSTRACT

A retractable step assembly has a U-shaped step, a rotatable joint including a bracket, a first member to fix the bracket to the rear of a boat or personal watercraft, to a fixed step, a pivotable rod, and a second member to fix the U-shaped step to it for rotation with respect to the first member. The joint includes two rings which are fixed to the bracket and a tube disposed within the rings at each end for rotation around the axis of the tube and rings. One of the assemblies is fixed to the tube and another assembly is fixed to the bracket. The bracket has two springs fixed to it and also acting on the tube or the assembly connected to the tube to rotationally bias the tube and assembly with respect to the bracket. In another embodiment, a retractable step is rotatably connected to the underside of a boat or swim platform of a boat by a plurality of rods, two of the rods being connected to the retractable step using the bracket, and a third rod being connected to a U-shaped bar allowing rotation of the bar with respect to the rod to provide a three-point attachment to the underside of the boat or platform.

18 Claims, 4 Drawing Sheets

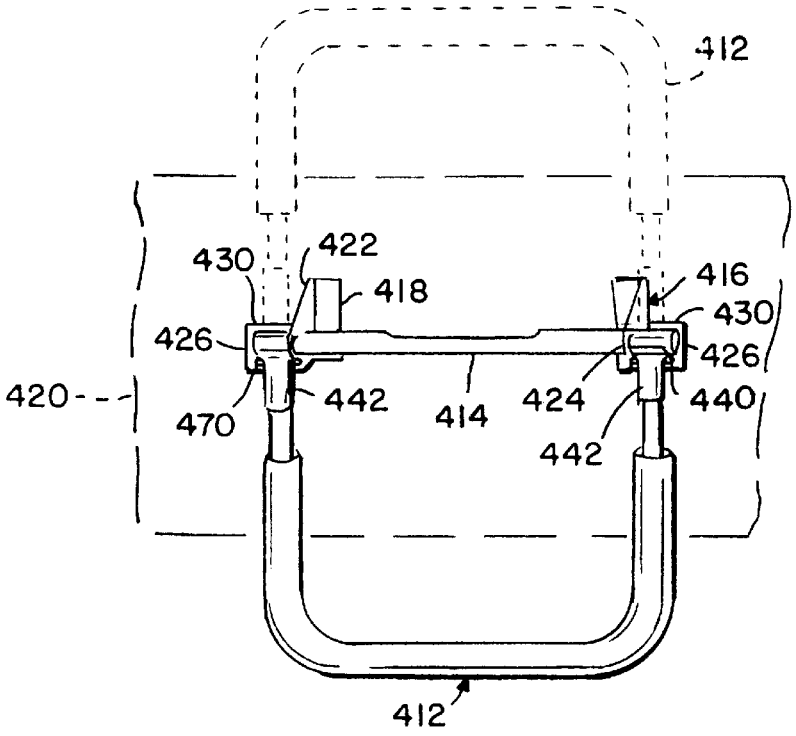
FIG. 9
FIG. 10
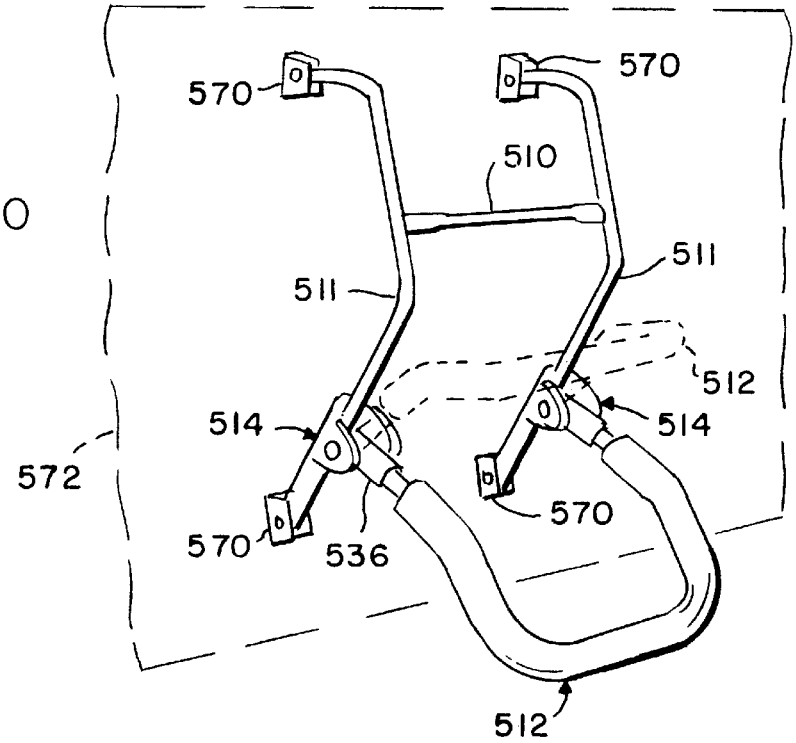

BOAT STEP WITH IMPROVED SUPPORT AND RETRACTION MECHANISM

BACKGROUND OF THE INVENTION

1. Field of the Invention

The present invention relates to a boat or watercraft step with an improved support and retracting mechanism, and in particularly, to such a step having an enhanced spring pivot joint.

2. Description of the Related Art

In watercraft such as personal watercraft and boats, it is desirable to have an outboard step, which assists a user in boarding a personal watercraft or boat, e.g., from the water after falling off, swimming or water skiing. In U.S. Pat. No. 5,152,244, for which the present inventor was an inventor, a retractable stirrup having a U-shape is disclosed which pivotably mounts at its ends by means of two (2) brackets to the transom of a personal watercraft. A torsion spring has one end acting on the bracket and another end acting on the end of the U-shaped step. The joint is made by using a cylindrical sleeve fixedly mounted to the bracket and the spring is disposed over the sleeve. The end of the spring acting on the bracket is disposed in a slot formed in the sleeve. The end of the U-shaped member is pivotably connected to the sleeve by passing the sleeve through the tube.

In U.S. Pat. No. 5,458,080 to the present inventor, a retractable step assembly for a boat is disclosed. The assembly is formed by providing tubes disposed at the ends of a U-shaped retractable step, which tubes mate in a male-female fashion with tubes which are part of a mounting assembly. The tubes connected to the step are rotatable with respect to the tubes of the mounting assembly. A torsion spring is provided at the joint formed by the male-female connection and has one end acting on the retractable step and the other end acting on the mounting assembly. This disclosed embodiment provides limited space for a spring, as does the previously-mentioned U.S. Pat. No. 5,152,244. It is desirable to provide more space for a spring to obtain greater bias strength, and greater support for vertical and lateral forces and to enable the use of heavier materials, such as stainless steel rather than aluminum. Stainless steel is more durable, stronger and less subject to corrosion in a water or saltwater environment. In addition, it is desirable to provide a joint with greater durability and stability for use.

SUMMARY OF THE INVENTION

In one embodiment, the present invention provides a torsion spring-loaded joint for a watercraft retractable step. The retractable step has a U-shaped retractable step and a mounting assembly. The mounting assembly is a bracket either fixed directly to a boat or watercraft or to another assembly such as a step or support brace which are in turn fixed to a boat or watercraft. The ends of the U-shaped step have a transverse tube fixed thereto which tube mates with annular members fixed to the brackets. Each bracket has two (2) annular members to receive, in either male or female connection, the transverse tube. The transverse tube is rotatable with respect to the annular members, such that rotation of the tube will cause the entire U-step to rotate. Torsion springs are located at this joint with one end acting on the U-shaped step and the other end acting on and preferably fixed to the bracket. The end of the spring which acts on the U-shaped step passes through a hole in the tube so that it may engage the inside of the step.

The bracket itself may be screwed or otherwise fixed to the hole of a boat or watercraft, or screwed or otherwise fixed to a support which may have a tubular shape.

The spring member may, in accordance with a preferred embodiment of the invention, be formed by two (2) springs, each of which has an end passing through the hole in the tube to act on the U-shaped step and each of which has an end which is acting on and preferably fixed to the bracket. The springs may be symmetrically placed within the tube.

The invention provides enhanced strength to the joint against tension such as caused by a person pulling down the step or stepping on it. It also provides good lateral strength for the joint for side-to-side movement of the transverse tube with respect to the annular members of the bracket, the bracket functioning as a stopper for each end of the tube. The bracket may also be provided with a reinforcing bar to enhance its strength.

In addition, the invention provides the opportunity for use of a strong spring force, in particular, providing two (2) springs, to create sufficient force to use heavier materials for the steps such as stainless steel. The springs and step because of its symmetrical construction at the joint also provide enhanced stability, durability and strength.

In another embodiment of the invention, a retractable step for the underside of a boat or watercraft has at least three (3) points of connection to the hull or underside of the watercraft. Such a step has three (3) or more support bars each with one end pivotably connected to a bracket which fixes them to the underside of the watercraft, and the other end pivotably connected to a retractable step assembly. The retractable step assembly is formed by a U-shaped step which also is connected to a cross-brace connected to or proximate the ends of the U-shaped step. The ends of two (2) of the support bars are connected to the ends of the U-shaped step, directly or indirectly, by means of a bracket or mounting assembly such as that of the previous embodiment. However, the support bars which are connected to the underside of the boat at one end are connected to these brackets at the other end by means of the transverse tubes, rather than connecting the step to the transverse tubes.

In operation, the springs bias the U-shaped step to rotate upward with respect to the three (3) or more support members and also tend to rotate the support members upward to hold the spring under the boat's footprint. Pulling down on the step rotates the step with respect to the support members and also pulls down the support members to rotate them with respect to the boat. The rotation of the support members is in an opposite direction to the rotation of the step and thus serves to translate the step to some extent from below the boat to a position where it is outside the footprint of the boat so that it may more easily be stepped on and used.

BRIEF DESCRIPTION OF THE DRAWINGS

FIG. 9 is a view of a further embodiment of a step using a joint in accordance with the invention, which step includes a retractable step and a fixed step, showing the step in its boarding position in solid lines and in its retracted position in phantom; and FIG. 10 is a perspective view of an alternate embodiment of a boat step using a bracket such as used in the step of FIG. 7 in accordance with the invention, and showing the step in a boarding position in solid lines and in a retracted position in phantom.

DESCRIPTION OF THE PREFERRED EMBODIMENT(S)

Figure 1:
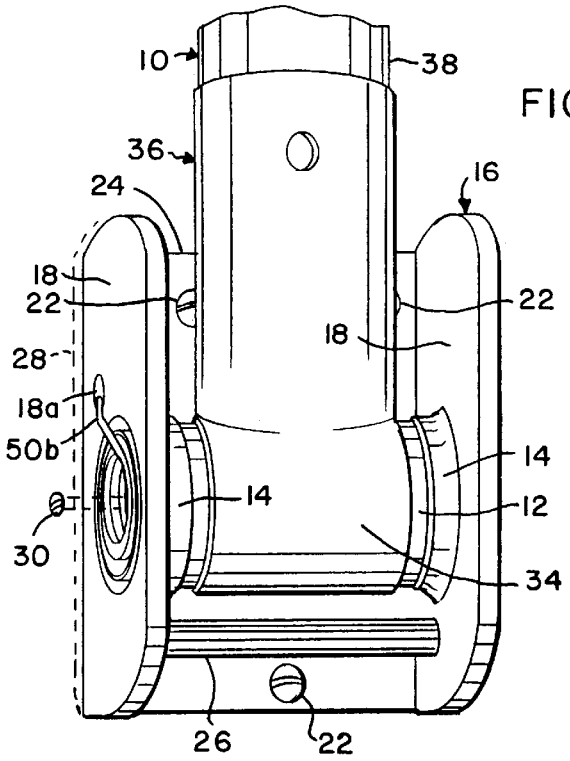
FIG. 1 is a front perspective view of an attachment of a bracket and the end of a U-shaped step forming a joint in accordance with the invention.
Figure 2:
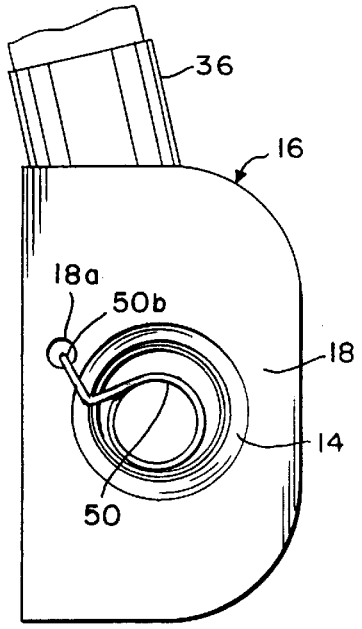
FIG. 2 is a side view of the bracket of FIG. 1 with a cover plate of the bracket removed.
Figure 3:
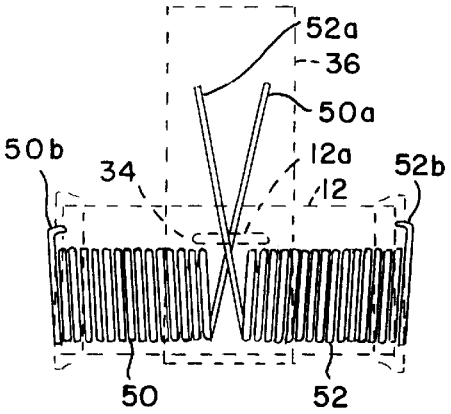
FIG. 3 is a view of two torsion springs and showing in phantom their position within the joint.

FIGS. 1–3 show a first embodiment of a joint including a bracket in accordance with the invention. A retractable step assembly includes a U-shaped retractable step connected by means of a spring-biased joint to a personal watercraft 2. The joint includes a tube 12 attached at its ends to two rings or annular support elements 14. Rings 14 are fixed or unitary with a bracket 16. Bracket 16 has sides 18 which support rings 14. Sides 18 also preferably have apertures coincident with rings 14. The bracket is fixed to a boat or personal watercraft at its transom 20 by means of screws 22 at a rear plate 24 of bracket 16. The sides may be reinforced by a bar 26 extending between the inner faces of the side member and disposed below the tube. This reinforcing bar functions as a stopper to limit the range of rotational motion of the retractable step when the step is in use.

A decorative and/or protective cover plate 28 is fixed to the outside of the sides (FIG. 1) by a bolt 30 which may pass all the way through tube 12 and the far ring 14 and be fixed to a nut on a cover plate on the outer side of the far side 18.

Tube 12 is fixed, e.g., by welding, to the inside of a cylindrical portion 34 of a sleeve 36 which provides a way to fixedly connect, e.g., by welding, tube 12 to the sleeve and the sleeve to an end 38 of U-shaped step 10 by a bolt. The bolt may pass all the way through the sleeve 36 and end 38 and have a nut to fasten the other side.

Tube 12 and rings 14 meet in a male-female relation and are rotatable with respect to each other. Sleeve 36 serves to stop lateral motion of tube 12 with respect to rings 14, and rings 14 provide vertical support for the tube and thus the step. This makes the step strong and stable against the force of a person pulling or stepping on it.

Tube 12 has a torsion element acting on it to rotate the tube with respect to the rings, and thereby bias the U-shaped step 10 with respect to the bracket 16. The torsion element is preferably formed by two torsion springs 50, 52 symmetrically placed therein. Each spring 50, 52 has one inner end 50*a*, 52*a* which acts on the step through the sleeve 36, and one outer end 50*b*, 52*b* which is connected to and acts on the brackets 16. The inner ends pass through a hole 12*a* in tube 12, and thus engage the tube 12 and/or the inside of the sleeve. The outer ends 50*b*, 52*b* are each fixed or disposed in holes or channels 18*a* in sides 18.

Figure 4:
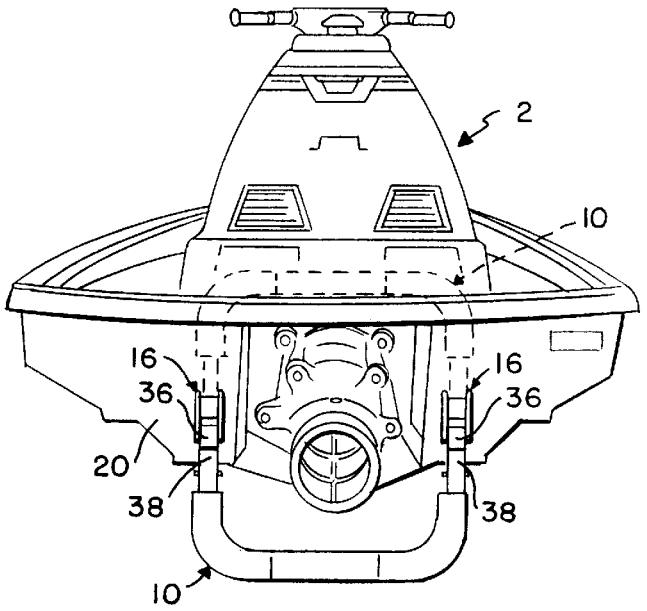
FIG. 4 is a view of a bracket of FIG. 1 being used to attach a step to a personal watercraft in accordance with one embodiment of the invention showing the step in its boarding position in solid lines and in its retracted position in phantom.

The torsion springs 50, 52 tend to rotate sleeve 36 upward which biases the step upward to its retracted position shown in phantom in FIG. 4. When a user pulls down the step or stirrup and/or steps on or kneels on it, the step rotates until sleeve 36 hits bar 26.

As shown in FIG. 4, there are two brackets, one at each end of the U-shaped step 10.

Figure 5:
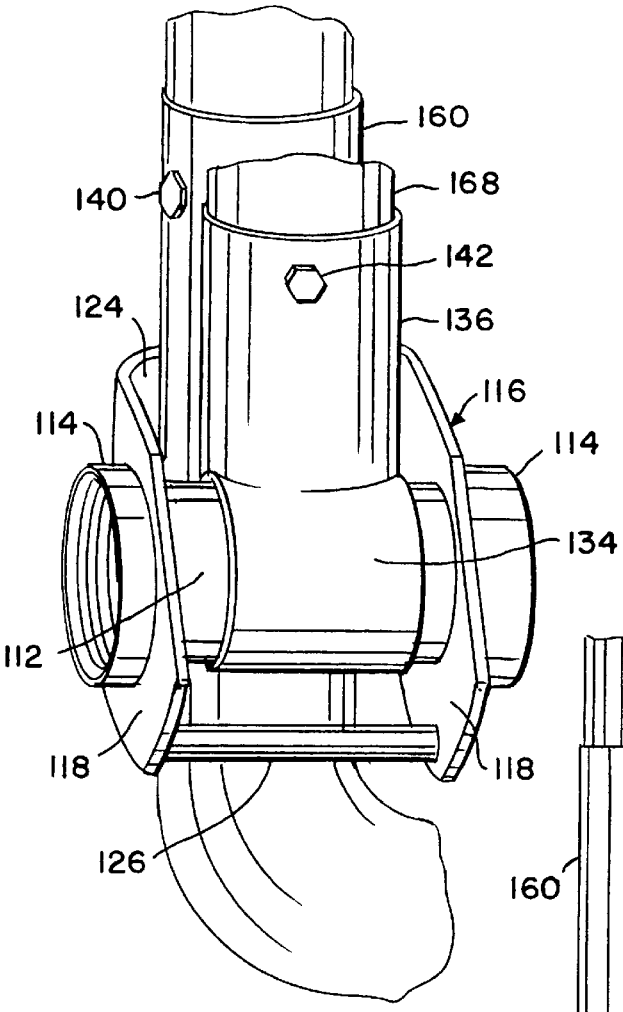
FIG. 5 is a view similar to FIG. 1 of a second embodiment of a joint including a bracket according to the invention.
Figure 6:
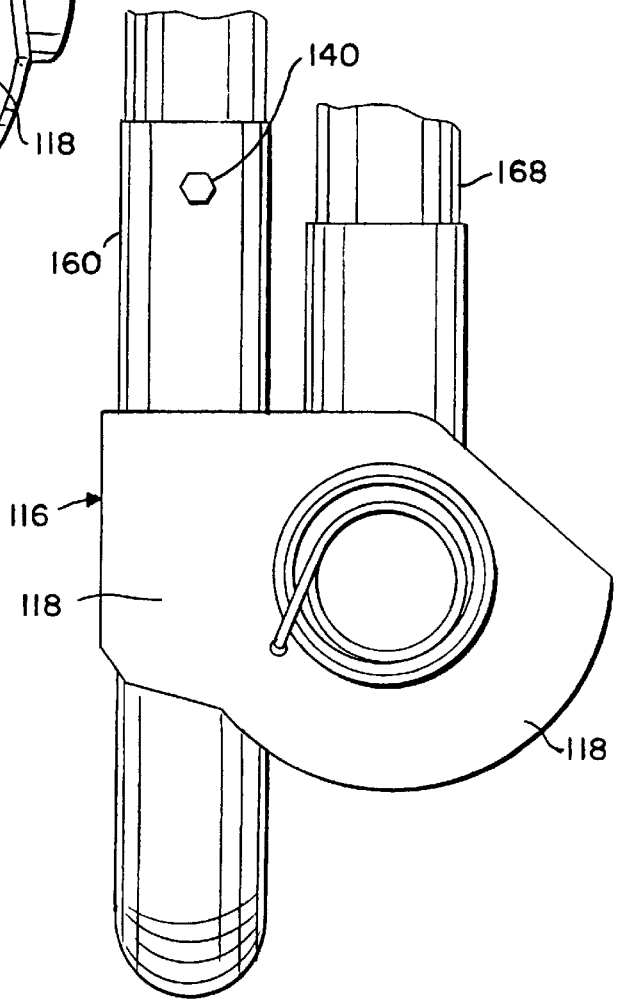
FIG. 6 is a side view of the joint of FIG. 5 without a cover plate on the bracket.

FIGS. 5 and 6 show an alternate embodiment of the bracket and joint, where the step is connected to another step, rod or bar. Bracket 116 has sides 118 which include rings 114. A tube 112 is fixed to and within a cylindrical portion 134 of a sleeve 136. Tube 112 rotatably mates with rings 114, each end of tube 112 being fit in a male-female relation with the rings. In the disclosed embodiment, the tube fits within the rings, but it would work equally well to put the tube around the rings.

The sleeve 136 is connected to rod 168 which may be an end of a U-shaped step, or another rod or bar such as a fixed step, or a movable rod. Bracket 116 may also have a stopper and support or reinforcing bar 126. So far, the construction and operation of the joint is as in the first embodiment. Also as in the first embodiment, two (2) torsion springs are disposed within tube 112 and connected to the bracket and through a hole in tube 112 to either act on the tube 112 or sleeve 136 to rotate the step.

To accommodate connection to another step, rod or bar, this joint has the following further characteristics. Bracket 116, instead of a flat rear plate 24, has a curved rear wall 124 which receives a tubular member 160. The bracket thus is not designed for mounting to a flat support surface as in the embodiment of FIG. 1 (although it could have a flat rear plate), but rather for mounting the U-shaped step to another bar, rod or step. Member 160 is fixed to wall 124 with bolts and nuts, or is welded, or otherwise fixed to the bracket 116.

Figure 7:
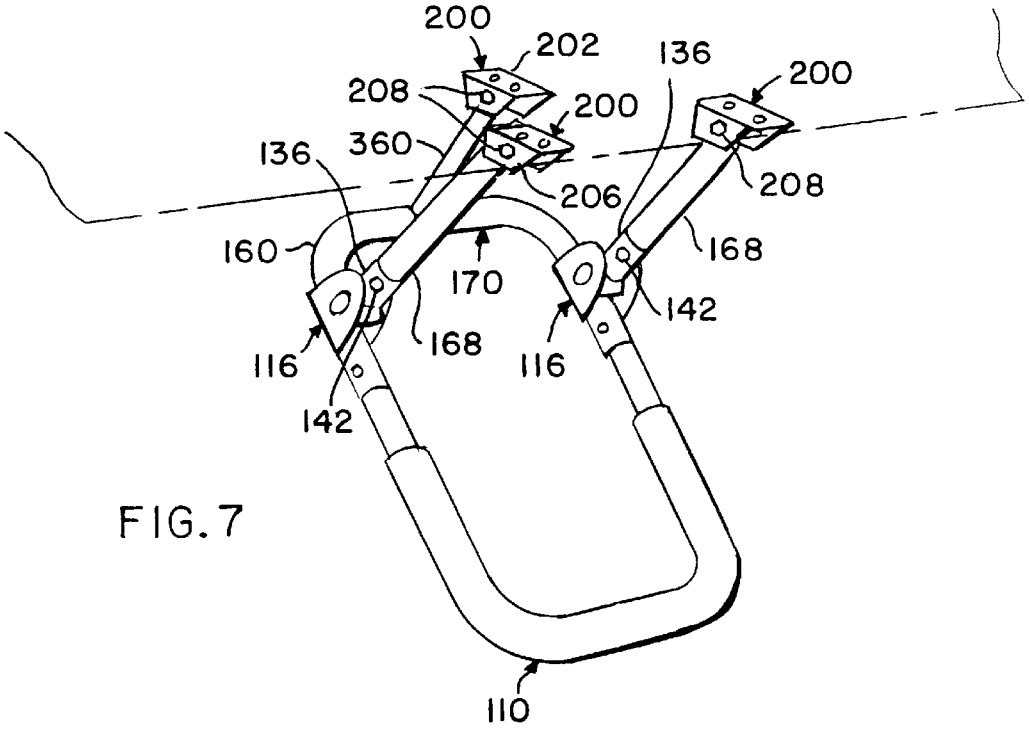
FIG. 7 is a perspective view of a step in its boarding position and having at least a three-point attachment to the underside of a boat in accordance with another aspect of the invention, and using a bracket such as shown in FIGS. 5 and 6 to form another joint in accordance with the invention.

As shown in FIG. 7, two such brackets 116 are each fixed to tubular members 160. Each member 160 is part of a shallow U-shaped element 170. The ends of a U-shaped step 110 are fixed to the ends of the U-shaped element 170 by bolts 140 and nuts. Rods 168 are fixed to sleeves 136 by bolts 142 and nuts. In this embodiment, it is the step 110 that is actually fixed with respect to the brackets 116, while rods 168 are pivotably connected to the bracket. Thus, the tubular ends 160 of the U-shaped element 170 are fixed to the rear plate of the bracket 116 as in the embodiment of FIGS. 5 and 6, while the rods 168 are connected to sleeves 136 that connect to tube 112 which is rotatably supported in rings 114 in the bracket 116. The embodiment shown in FIG. 7 uses the brackets of FIGS. 5 and 6 and simply reverses the connection of the step and the support rods to the bracket in contrast to the connection of FIGS. 1 and 4. This has the effect that the bracket will bias the step 110 to rotate upward to the position of FIG. 8 (a view from the bottom looking up) such that it is stowed underneath the boat or swim platform.

Figure 8:
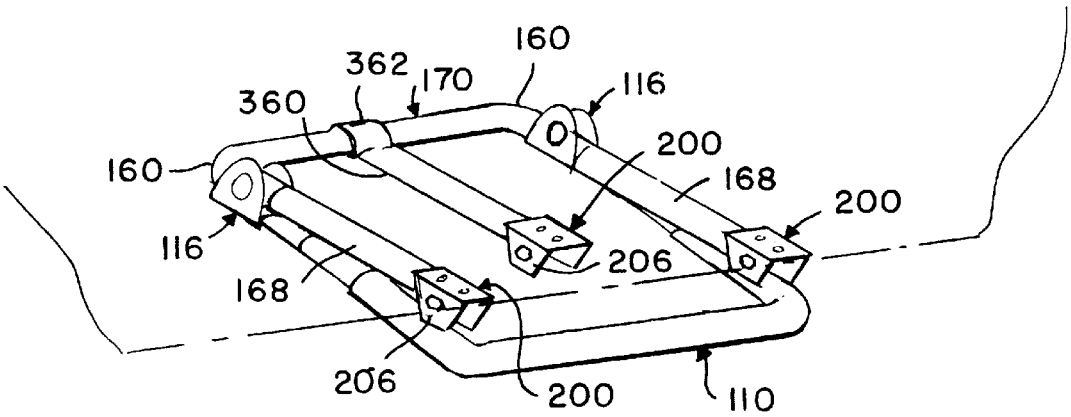
FIG. 8 is a view of the step of FIG. 7 in retracted position as viewed from the underside of the boat.

The retractable step assembly of FIGS. 7 and 8 is also an embodiment of a three (3) or more point attachment of the step assembly to the boat. There are three (3) brackets 200 which have a back plate 202 where screws attach the bracket to the boat or swim platform and side plates 206 are unitary or integral with the back plate 202. A bolt 208 passes through the side plates 206 and is fastened by a nut. For each bracket 200 there is a rod 168 journaled to each bolt 208 so that rods 168 freely rotate with respect to the brackets 200. Two brackets 200 are proximate the end of the boat (or swim platform) and one is located somewhat inward and centered with respect to the other two. The two rods 168 at their remote ends from the boat pivotably connect to the bracket 116. The rods 168 at their ends which are remote from the boat are fixed to sleeve 136 as explained above. Also, as in FIGS. 5 and 6, the sleeve 136 has a cylindrical end in which the tube 112 is fixed, the tube 112 being journaled in a male-female relationship to the two inwardly protruding rings 114 mounted to the sides of bracket 116. Inside the tube there are two torsion springs each having a first end acting on the tube 112 or sleeve 136, and a second end connected to and acting to bracket 116, e.g., by fixing it to its side walls as in the embodiment of FIGS. 5 and 6. Another rod 360 has an end 362 with a cylindrical shape through which the base of U-shaped bracket 170 is rotatably disposed. The other end of the rod 360 is connected to one bracket 200 fixed to the underside of the boat or swim platform in identical fashion as the bars or rods 168 are connected to brackets 200.

In operation, the step is biased into the position of FIG. 8. The torsion springs tend to rotate step 110 upward with respect to the rods 168, 360 toward the position of FIG. 8. As the step rotates, the rods 168 also tend to rotate upward forcing the rod 360 to rotate upward to the position of FIG. 8, due to the pivotable connection of the rods 168, 360 to the boat. When the user pulls downward or steps on step 110, this rotates the step against the bias of the springs and thus also pulls downward the rods 168, 360. Because of their pivotable connection to the boat, this also translates the step 110 out from underneath the footprint of the boat or swim platform.

It should be noted that instead of a three-point attachment to the boat, an additional rod 360 may be used, and in such an embodiment, it would be preferable to connect the two rods to the U-shaped element 170 symmetrically with respect to the center of the U-shaped element 170.

FIGS. 9 and 10 show additional embodiments of the invention. FIG. 9 shows a retractable step and fixed step assembly including a U-shaped step 412, a fixed step 414 and a bracket 416. Bracket 416 includes a rear portion 418 for mounting to boat transom 420, extension portions 422, two side walls 424, 426 and a connecting portion 430 connecting the side wall 426 to the extension portion 422, the side wall 424 being integrally or unitarily fixed to the extension portion 422. The side walls 424, 426 each have rings as in previous embodiments, which rings rotatably receive a tube 440 fixed to the cylindrical extension of a sleeve 442 by welding or otherwise. At the end of the sleeve remote from the cylinder 440, the sleeve 442 is connected by means of a bolt and a nut to U-shaped rotatable step 412.

The springs inside the tube are attached as in the previous embodiment shown in FIG. 3. The fixed step 414 can also be supported by inward projecting rings on inner side walls 424 and may be welded or otherwise fixed thereto. As in prior embodiments, the rings may extend outward from the bracket side walls, and the tube may be fitted in the rings, or the rings extend inward and the tube fitted over them or inside them.

As in prior embodiments, there is also a reinforcing bar and stopper extending below the pivotable connection of the retractable step and between the side walls of the bracket. In operation, the torsion springs bias the step upward to the position shown in phantom. When stepped on or pulled down, the step rotates until it contacts the stopper or reinforcing rod 470. Thus, the retracted position is shown in phantom, while the boarding position is shown in solid lines.

FIG. 10 shows an embodiment of a fixed step 510 and a rotatable step 512. The ends of the rotatable step 512 fasten to sleeves 536 by means of a bolt and nut. The sleeve then has a cylindrical member at its other end for fitting around a tube connected to the bracket 514 by a male-female rotatable connection to rings as in the embodiments of FIGS. 5 and 6. The fixed step 510 has two downwardly extending rods 511 that are fixed by brackets 570 to the transom 572 of a boat. The rods 511 are fixed to the rear plate of bracket 514 as in previous embodiments. Thus, the U-shaped step 512 will be biased by torsional springs to rotate upward into the retracted position of FIG. 10 shown in phantom. When the step is pulled down or stepped on, step 512 will rotate to the boarding position shown in solid lines in FIG. 10. It should be noted that FIG. 10 shows four (4) brackets 570 which fix the fixed step assembly 510 to the stern or transom 572 of the boat. However, the fixed step at its top portion may be a top mount for attachment to the top of the boat rather than the rear.

While the present invention has been described with regards to particular embodiments, it is recognized that additional variations of the present invention may be devised without departing from the inventive concept.

What is claimed is:

1. A step assembly for a watercraft, comprising:

a U-shaped step having first and second ends; and a support assembly comprising means for mounting the step to the watercraft, and further comprising two joints for pivotably attaching the U-shaped step to the means for mounting, each joint including a tubular member and a bracket comprising two annular members for rotatably receiving ends of the tubular member, and torsion means fixed with respect to the bracket for rotatably biasing the tubular member with respect to the bracket, the means for mounting being fixed to one of the bracket and the tubular member, and each end of the U-shaped step being fixed to the other of the bracket and the tubular member, such that the tubular member is rotatable with respect to the bracket, whereby the U-shaped step is rotatably biased with respect to the means for mounting.

2. The step assembly of claim 1 wherein the torsion means comprises two springs.

3. The step assembly of claim 1 wherein the means for mounting is fixed to the bracket, and the torsion means is disposed inside the tubular member.

4. The step assembly of claim 1 wherein the joint further comprises means for connecting the U-shaped step to the tubular member, the means for connecting comprising a sleeve fixed to the ends of the U-shaped step, the sleeve being fixed to the tubular member.

5. The step assembly of claim 4 wherein the sleeve connects to the tube and is disposed perpendicular thereto and for rotation between the annular member.

6. The step assembly of claim 1 wherein the ends of the tubular member are disposed inside the annular members.

7. The step assembly of claim 1 wherein the means for mounting comprises a movable rod.

8. The step assembly of claim 1 wherein the means for mounting comprises a fixed rod.

9. The step assembly of claim 1 wherein the means for mounting comprises a fixed step.

10. The step assembly of claim 1 wherein the bracket has side walls, the annular members are fixed to the side walls and the torsion means comprises two torsion springs disposed inside the tubular member and each having one end fixed to a respective one of the brackets, and another end acting on the tubular member.

11. The step assembly of claim 1 wherein the U-shaped step is fixed to the tubular member, and the means for mounting is fixed to the bracket.

12. The step assembly of claim 1 wherein the U-shaped step is fixed to the bracket and the means for mounting is fixed to the tubular member.

13. The step assembly of claim 1 further comprising a fixed step extending between and connected to each bracket.

14. A step assembly for a watercraft comprising:

first, second and third rods each having first and second ends;

means for pivotably attaching the first end of each of the first, second and third rods to the watercraft;

a retractable step assembly including a U-shaped step and a member connected to the step;

two brackets for pivotably connecting the retractable step assembly to the second ends of the first and second rods; and means for pivotably connecting the second end of the third rod to the member, wherein the two brackets include means for rotatably biasing the retractable step assembly towards the first and second rods to retract the retractable step, and for thereby rotating the first, second and third rods about their first ends towards the watercraft and wherein the two brackets further comprise annular rings fixed thereto the retractable step assembly is fixed to the two brackets, the means for rotating includes a tube and torsion means for rotating the tube, and the first and second rods are connected at their second ends to the brackets by the tube fitted to the rings in male-female relation proximate each end of the tube, and the tube is rotatable with respect to the rings.

15. The step assembly of claim 14 wherein the third rod is centered with respect to the first and second rods.

16. The step assembly of claim 14 wherein the ends of the tube are disposed inside the rings.

17. The step assembly of claim 14 wherein the means for rotatably biasing comprises two torsion springs disposed inside the tube and each having one end extending out of the tube and fixed to the bracket and the other end acting on the tubular member.

18. The step assembly of claim 14 wherein the step assembly comprises stainless steel.

* * * * *